United States Patent [19]

Lacan

[11] 3,964,006

[45] June 15, 1976

[54] ELECTRICAL APPARATUS

[75] Inventor: Guy Lacan, Carrieres-sous-Bois, France

[73] Assignee: La Telemecanique Electrique, France

[22] Filed: Dec. 26, 1974

[21] Appl. No.: 536,570

[30] Foreign Application Priority Data

Jan. 3, 1974 France ..... 74.00159

[52] U.S. Cl. ..... 335/132; 335/202

[51] Int. Cl.[2] ..... H01H 50/04

[58] Field of Search ..... 335/132, 202

[56] References Cited

UNITED STATES PATENTS

| | | | |
|---|---|---|---|
| 3,458,838 | 7/1969 | Isler | 335/132 |
| 3,548,349 | 12/1970 | Fujita | 335/132 |
| 3,569,878 | 3/1971 | Grass et al. | 335/132 |
| 3,740,510 | 6/1973 | Grunert | 335/132 |
| 3,781,727 | 12/1973 | Pollmann et al. | 335/132 |
| 3,806,849 | 4/1974 | Hughes | 335/132 |

*Primary Examiner*—Harold Broome
*Attorney, Agent, or Firm*—William A. Drucker

[57] ABSTRACT

The invention relates to electrical commutation apparatus of the kind having a fixed core, a coil, a movable armature constituting a motor, a frame including shaped engaging means placed perpendicularly to the movement of the armature to support a number of housings each containing fixed and movable elements of a contact, and a shaped body member for control of said contacts. The object is to provide improvements in dimensions, avoidance of vulnerability to dirt, and adequate rigidity without undue bulk. These are obtained in that the frame and the control member are each constituted by at least one portion of a prismatic body cut longitudinally and in that the shaped body comprises at least the engaging means for the housings and the surfaces for guiding movements of the armature.

5 Claims, 3 Drawing Figures

ELECTRICAL APPARATUS

Figure 1:
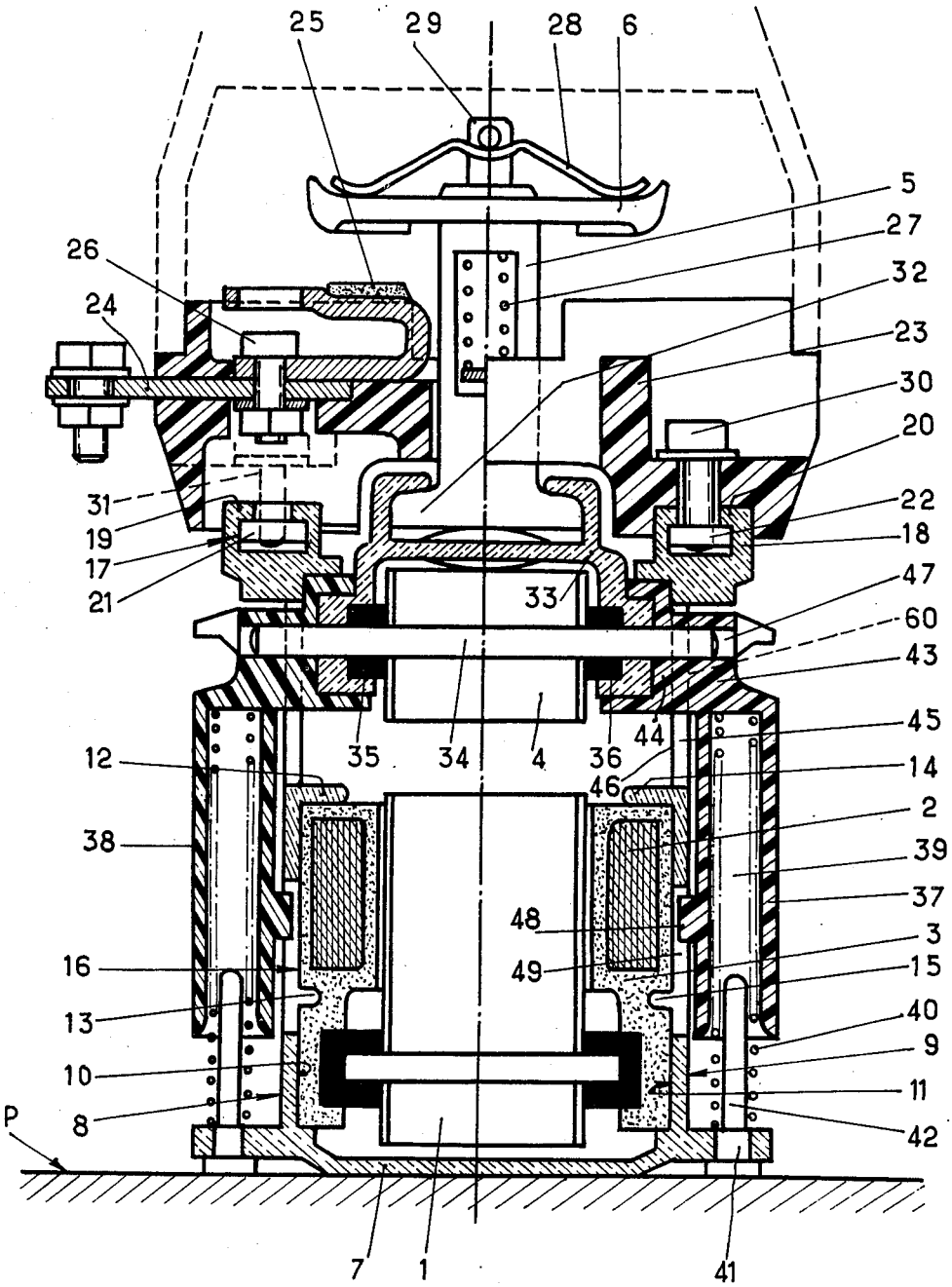

The invention relates to a contactor comprising a structure having two portions parallel to a direction and intended to receive a variable number of removable elementary contacts fixed at two points perpendicular to this direction, and a movable member of elongated shape placed parallel to said direction which is coupled, on the one hand, to movable elements of the electro-magnetic motor system and, on the other hand, to movable elements of the contacts. Such contactors are, in particular, applied to the commutation of medium voltage circuits where the current flows are greater than 100 amperes.

There are already known contactors, conforming to the prior art defined above, in which use is made of parallel bars to assure the retention of various members which constitute them; nevertheless these systems have numerous disadvantages resulting from their construction in the form of a framework.

In the first place their dimensions are generally prohibitive, which makes it a difficult matter to incorporate them in cabinets or tables which, furthermore, must fall in with the general tendency towards lessening of bulk.

Further, the constitution of these apparatus renders them vulnerable to dirt which has a tendency to accumulate in the least desirable places: bars, magnetic poles etc.

Finally, the dimensions which they have make it difficult to construct a rigid frame, to the extent that this property can only be obtained by an increase of the cross-section of the supports which has a result to make these apparatus heavy.

When the required rigidity has been obtained, one then has an apparatus which is unsymmetrical in construction and which, consequently, may be sensitive to transitory phenomena and to large enough blows.

On the contrary, these apparatus are generally well cooled and their construction permits relatively simple mounting and maintenance.

The invention therefore proposes to provide in the apparatus of the prior art some features as a result of which the proper advantages will be retained and even improved, whilst bringing thereto remedies for the inconveniences indicated above, with the aid of members of a very useful manufacturing cost. The invention further provides a system with which the presentation of the elements will permit the construction of contact breakers with multiple poles, by the assembly of a certain number of units of independent contacts with a body obtained by cutting longitudinally prismatic elements adapted to fulfill several functions. Furthermore, these features will contribute to modifying the undesirable appearance of these known apparatus and to assuring for them a resemblance with the apparatus of lower power which will give an appearance more agreeable to the eye.

According to the invention this result is obtained from the fact that the body of the contactor comprises a first set of slideways parallel to the plane of fixation of the apparatus, assuring the support of the fixed elements of the motor system that the portions are represented by a second set of slideways provided with flanges and of the same orientation as the first set to which it is directly coupled, that the movable member is constituted by a third slideway with flanges parallel to the preceding ones situated substantially in the median plane passing between the slideways of the first set, that each elementary contact has a member for coupling its movable portion which can be coupled in releasable manner to the third slideway by a movement parallel to the latter, and coupling members adapted to co-operate with the second set of slideways.

Figure 3:
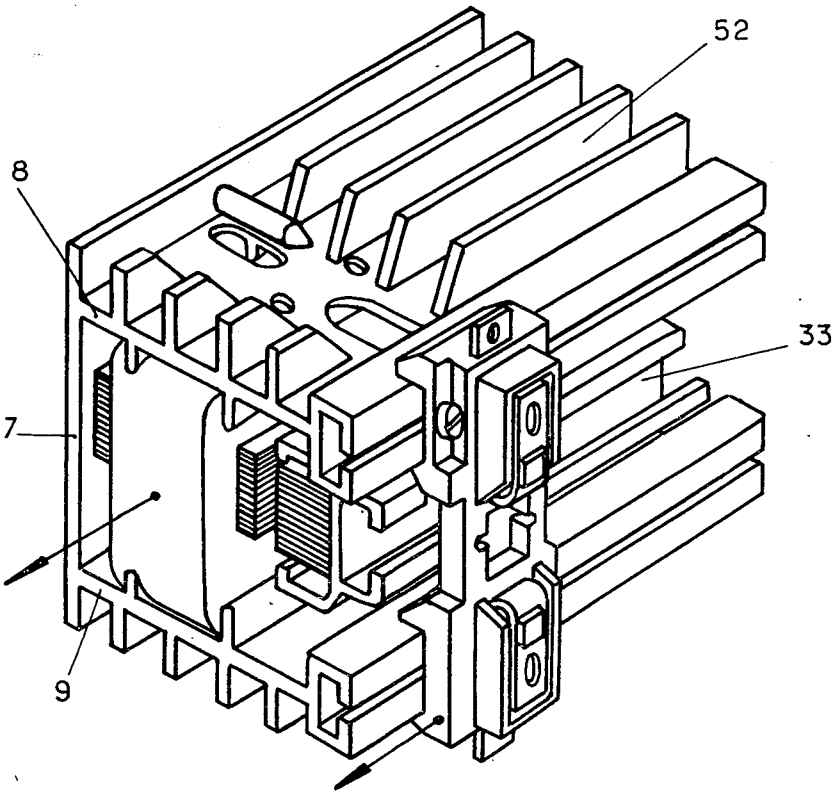
Figure 2:
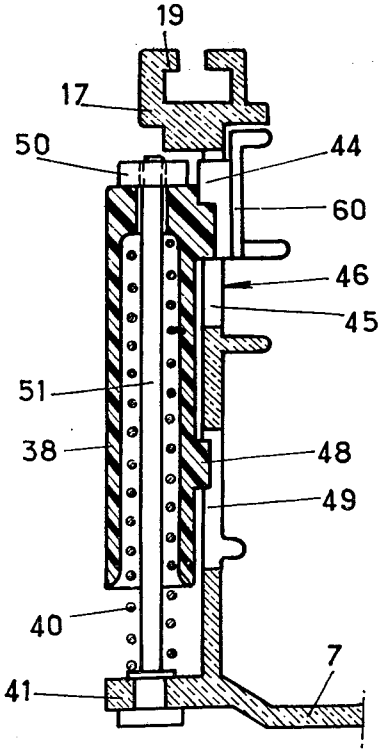

The advantages resulting from particular constructions will be better understood with reference to the following description which is illustrated by the following figures:

FIG. 1 which shows an elevation partially sectioned along the plane of symmetry passing through a contact block and partially along a plane passing through the member for fixing said block, FIG. 2 which illustrates a variation of construction of the stops of the half-slideway, FIG. 3 which shows in perspective the external appearance of a contactor equipped with a single contact block in which the upper half-slideway and the contact bearer have been removed.

The contactor shown in FIG. 1 comprises principally a fixed magnetic core 1 surrounded by an energising coil 2 enclosed within a moulded envelope 3 of plastic material, a movable armature 4 which transmits its movements to a contact carrier 5, the upper part of which is equipped with a bridge contact 6.

The frame of the apparatus is constituted by a prismatic solid comprising a base 7 adapted to be engaged on a fixing surface and two lateral wings 8 and 9 which give the frame the general shape of a U section profile. On each of the walls 10 and 11 of the wings 8 and 9 facing each other is disposed a first set of slideways 12, 13 and 14, 15 which are constituted in the example described by ribs.

These ribs which are in parallel with each other and with the surface of the base serve to guide in a first direction and support in a second perpendicular direction, the envelope 3 of the coil. For this purpose, this latter has edges and grooves adapted to co-operate with the ribs.

Furthermore, a large part of the surface 16 of the envelope of the coil is in mechanical contact with the internal walls 10 and 11 of the wings, in such a manner that the heat developed in the coil can flow out through them.

The extremities of the wings opposed to the base are provided with a second set of slideways 17 and 18 parallel to the first set and which have flanges 19, and 20. These flanges are intended to receive sliding bolts 21 and 22 which have for their purpose to fix on the frame one or more insulating supports such as 23.

These insulating supports constitute the base on which are grouped all the removable contact elements necessary for commutation of the electrical circuits, that is to say: the coupling terminals 24, the fixed contacts such as 25, the fixing screws for the fixed contacts such as 26, and finally the movable bridge contact carriers such as 5 which support the contact bridge 6 as well as their springs 27 and 28 and the engaging flange 29 and finally the screws 30, 31 which co-operate with the sliding bolts 21, 22.

The construction of the removable contact blocks is thus such that they can easily be put in place or changed in case of breakdown or modification by a movement parallel to the second set of slideways.

To permit the coupling of the movable part of the electro-magnetic motor in the course of putting into position the removable contacts, the contact bearer has as its extremity directed towards the base of the apparatus a head 32 in the form of a T which can co-operate with a third slideway 33 having a cross-section in the form of a C and slide along this latter when the removable contact is put into position.

This third slideway 33 which extends for a length which is a function of the number of contacts to be operated furthermore carries out the function of support of the movable armature 4 to which it is coupled by means of the pin 34 and resilient cushions 35, 36.

The system of guiding of the armature and the third slideway is provided by a slide carriage represented by two elements 37, 38, made of a plastics material having a good co-efficient of friction with the material of the wings 8, 9 and placed in the region of the external walls of the wings. It is thus obtained that the internal volume comprised between the wings in the neighbourhood of the base remains free for the placing in position of the core 1 and the coil 2, 3.

Each element of the slide carriage, such as 37, has a recess 39 into which enter, on the one hand, a return spring 40 bearing on a flange 41 integral with the base 7 and, on the other hand, a guide rod 42. The axis of this recess is perpendicular to the plane passing through the base and is consequently perpendicular to the two sets of slideways.

The extremity 43 of the element 37 of the slide carriage adjacent to the second set of slideways, 17, 18 comprises a first guide means constituted by a bracket 44 perpendicular to the axis of the recess 39 which lodges in an oblong opening 45 formed in a region, of the wing 9, situated between the two sets of slideways. This bracket 44 also has an enlargement 60 situated opposite to the internal face 46 of the wing 9 on which it bears to act as a shoe.

As this shoe is larger than the oblong opening 45, the slide carriage element will be put in place from the interior. A recess 47, formed in the bracket 44 permits to receive the pin 34 and to secure together all the movable elements of the electro-magnetic contactor motor.

The other extremity of the slide carriage element 37, adjacent to the fixing wall and to the base has a finger 48 which is inserted into a second oblong opening 49 of the wing to constitute a second means for guiding the slide carriage element.

This second oblong opening is disposed perpendicularly to the first set of slideways 14, 15 at the height of which it is situated.

The weight of the movable masses of the contactor is thus supported by the shoes 60, while their guiding is carried out by the bracket 44 and finger 48.

In the example shown in FIG. 1, the slide carriage elements bear in the rest position on the second set of slideways.

In the case where the contactor is submitted to very numerous operations, it can be advantageous to bring about the stopping of the movable members on a stop 50 integral with a rod 51 assuming the function of the guide rod 42 and secured to the frame in a flange 41 adjacent to the base, as can be seen in FIG. 2.

In the example of construction of FIG. 1, the frame is constituted principally by a single body obtained by extrusion in such a manner that the first and second sets of slideways are carried by the same wing. One could likewise form the frame by joining two identical extruded shaped bodies, representing only the wings, by a plate or by transverse members serving the purpose of the base 7. The slideway 33 is likewise obtained by extrusion.

In all the methods of construction, the rigidity of the frame is considerably improved when the removable contact blocks are put into position and secured by their fixing screws.

The dimensions of the apparatus which has been described are substantially more reduced than those of prior apparatus but the evacuation of heat given off by the electro-magnetic motor is favoured by the contact of this latter with the wings of the frame.

To further improve the external exchange, it is possible to provide the external wall of the wings with ribs 52 such as are shown on FIG. 3 where the upper half slide carriage has been removed to show the oblong openings 45, 49 serving to guide it.

It will be noted that the closed shape of the frame has the advantage of reducing deposit of dirt contained in the atmosphere.

Finally the construction of the apparatus permits, in a particularly simple manner, the provision of contactors with multiple contacts and it is sufficient in effect to truncate the length of the portions 7, 8, 9, 33 constituting the wings and the third slideway, and to assemble them with the motor elements and the required number of removable contacts to construct a contactor suitable for any paarticular need; such an apparatus is shown in the right hand part of FIG. 3.

It would be possible to associate several motors, either to a third slideway if the number of contacts to be actuated requires a greater driving force, or again to several third slideways intended to actuate associated contact elements having distinct functions, for example for inverters or for starting equipment.

I claim:

1. An electrical commutation apparatus comprising:

i. a frame having two substantially plane parallel wings and a base at one extremity of each of said wings, each of said wings having at its other extremity remote from said base one component of a respective first coupling assembly extending parallel to the base, at least one of said wings including a guiding opening extending normal to said base;

ii. a plurality of contact assemblies each comprising an insulating support containing at least one fixed contact and a carrier with a movable contact, said carrier having one component of a second coupling assembly extending parallel to the base, said insulating support having the other component of each of said first coupling assemblies;

iii. an assembly of a magnetic core and an associated energising coil secured in said frame and serving as the fixed portion of an electromagnetic motor;

iv. an armature positioned to coact with said core and constituting the other portion of said motor, said armature being secured to a carriage having the other component of said second coupling assembly, said carriage including means engaged in said guiding opening for movement therein normal to said base during movement of said armature towards and away from said base.

2. An electrical commutation apparatus, as claimed in claim 1, wherein said parallel wings and said magnetic core and coil assembly have cooperating guide means permitting engagement of the core and coil assembly into the frame by a movement parallel to the base.

3. An electrical commutation apparatus, as claimed in claim 2, wherein said cooperating guide means, and said other component of said second coupling assembly, are extruded.

4. An electrical commutation apparatus, as claimed in claim 1, wherein the longitudinal dimension of the parallel wings, in relation to the longitudinal dimension of the electromagnetic motor are such that two motors may be received in one such frame.

5. An electrical commutation apparatus, as claimed in claim 1, wherein said parallel wings are secured to said base, and wherein said base includes means for securing said frame to a support.

* * * * *